United States Patent [19]

Williams et al.

[11] 4,024,816

[45] May 24, 1977

[54] INKING ROLLER AND APPARATUS AND METHOD FOR PRINTING USING SUCH ROLLER

[75] Inventors: Leland E. Williams, Centerville, Ohio; James O. Griffith, Three Rivers, Mich.

[73] Assignee: Dayco Corporation, Dayton, Ohio

[22] Filed: Feb. 5, 1976

[21] Appl. No.: 655,342

[52] U.S. Cl. ..... 101/426; 101/269; 101/329; 101/367; 29/130

[51] Int. Cl.[2] ..... B41F 3/04

[58] Field of Search ..... 101/269–274, 101/45, 256, 56, 260, 348, 264, 354, 355, 367, 322–331, 426; 29/130, 125; 100/210

[56] References Cited

UNITED STATES PATENTS

| | | | |
|---|---|---|---|
| 3,018,725 | 1/1962 | Maul et al. | 101/269 |
| 3,138,091 | 6/1964 | Maul | 101/269 X |
| 3,221,653 | 12/1965 | Bell et al. | 101/269 |
| 3,481,269 | 12/1969 | Boown | 101/269 X |
| 3,491,685 | 1/1970 | Tramposch | 101/367 X |
| 3,709,144 | 1/1973 | Sims | 101/45 |
| 3,812,782 | 5/1974 | Funahashi | 101/367 |
| 3,820,458 | 6/1974 | McInnis | 101/269 |

*Primary Examiner*—Edward M. Coven
*Attorney, Agent, or Firm*—Reuben Wolk

[57] ABSTRACT

An inking roller is provided which has both inking and non-inking portions and which has substantially uniform deflection characteristics across its entire axial length; and, an improved apparatus and method for printing using such roller is also provided.

20 Claims, 15 Drawing Figures

INKING ROLLER AND APPARATUS AND METHOD FOR PRINTING USING SUCH ROLLER

BACKGROUND OF THE INVENTION

Printing apparatus and rollers in current use which employ a rigid rail to limit the movement of an inking roller toward an associated plate with a sheet to be printed disposed therebetween are deficient in that there is inking of the sheet adjoining raised characters of the printing plate as required; but, there is also smearing of ink adjacent such rail.

SUMMARY

It is a feature of this invention to provide an improved inking roller having both an inking portion and a non-inking portion and which has substantially uniform deflection characteristics across its entire axial length and with such roller being particularly adapted to be used in an apparatus for printing sheet material in a clear non-smearing manner.

Another feature of this invention is the provision of an inking roller having an outer cylindrical surface and comprising an inking portion defined by a tubular porous sintered mass of particles bonded together in a homogeneous recticulated open pore structure with the pores being interconnected and forming continuous passages between the outer surface and an inner surface of the structure; and, the roller has a non-inking portion defined by an ink impermeable member disposed on the cylindrical structure and defining at least a part of the outer surface with the roller having substantially uniform deflection characteristics across its entire axial length.

Another feature of this invention is the provision of an improved method of making an inking roller.

Another feature of this invention is the provision of an improved printing apparatus employing an inking roller of the character mentioned.

Another feature of this invention is the provision of an improved method of printing utilizing an inking roller of the character mentioned.

Accordingly, it is an object of this invention to provide an improved inking roller, a method of making such an inking roller, a printing apparatus, and a method of printing having one or more of the novel features set forth above or hereinafter shown or described.

Other details, features, objects, uses, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DETAILED DESCRIPTION OF THE INVENTION

Figure 1:
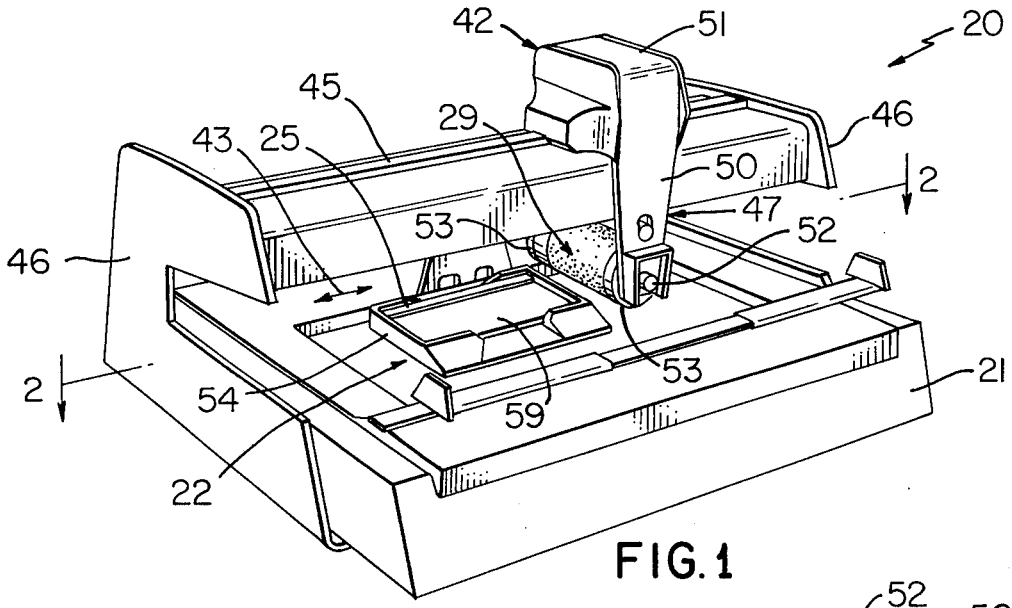
FIG. 1 is a perspective view illustrating one exemplary embodiment of a printing apparatus and method of printing of this invention which utilizes an inking roller of this invention.
Figure 2:
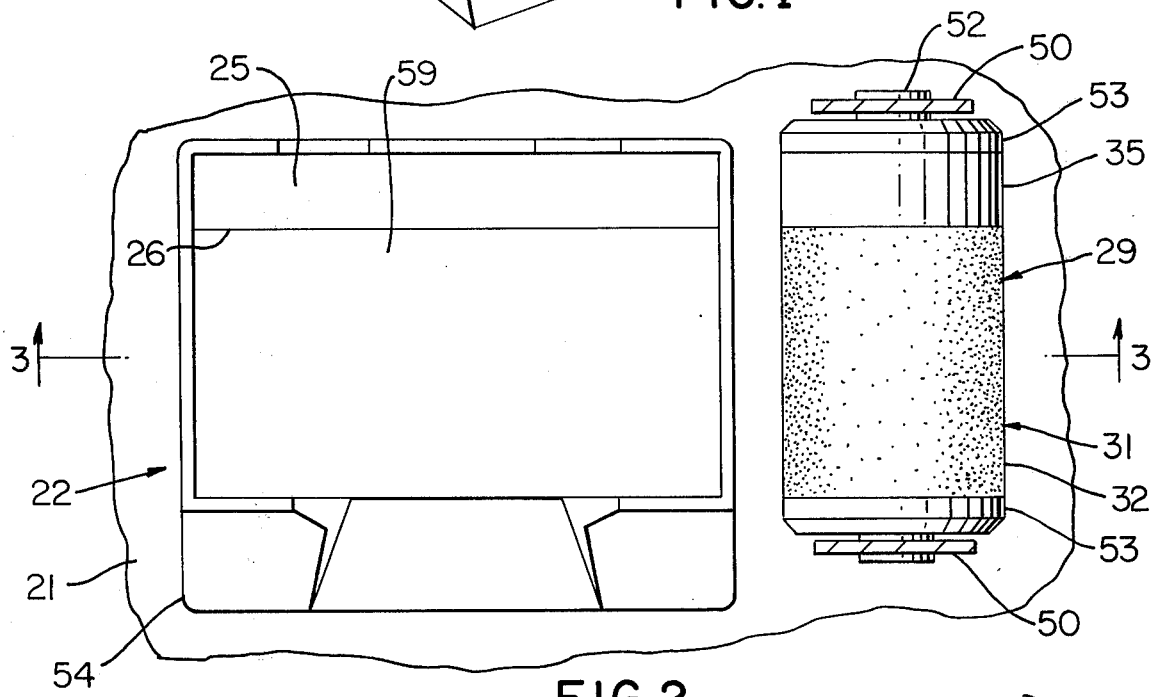
FIG. 2 is a view taken essentially on the line 2—2 of FIG. 1.
Figure 3:
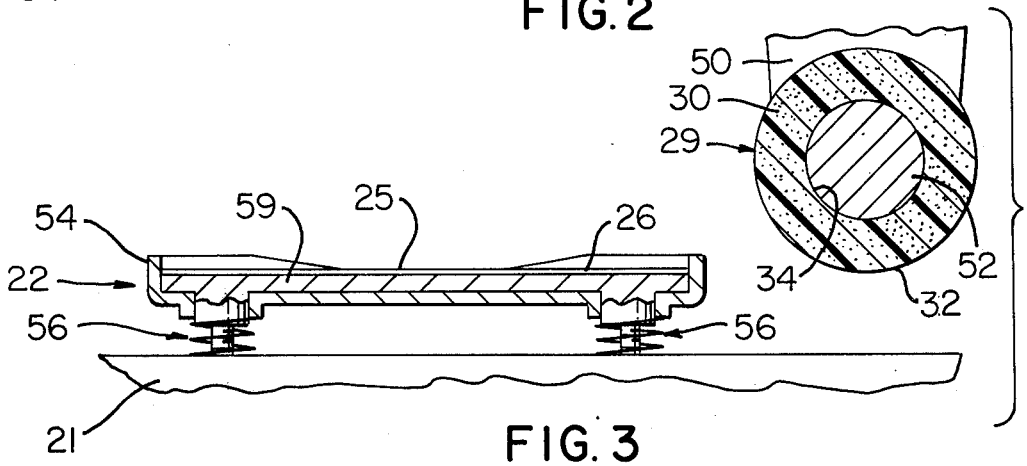
FIG. 3 is a view taken essentially on the line 3—3 of FIG. 2 with parts in cross section, parts in elevation, and parts broken away.
Figure 4:
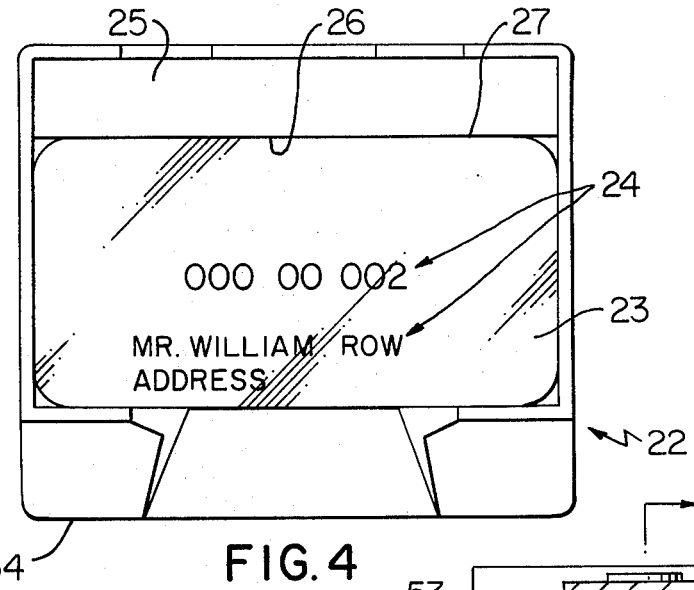
FIG. 4 is a fragmentary view particularly illustrating a printing plate supported in position on a support of the apparatus of FIG. 1 and also illustrating an elongated rail on such support and components associated with the rail used to confine the printing plate.
Figure 6:
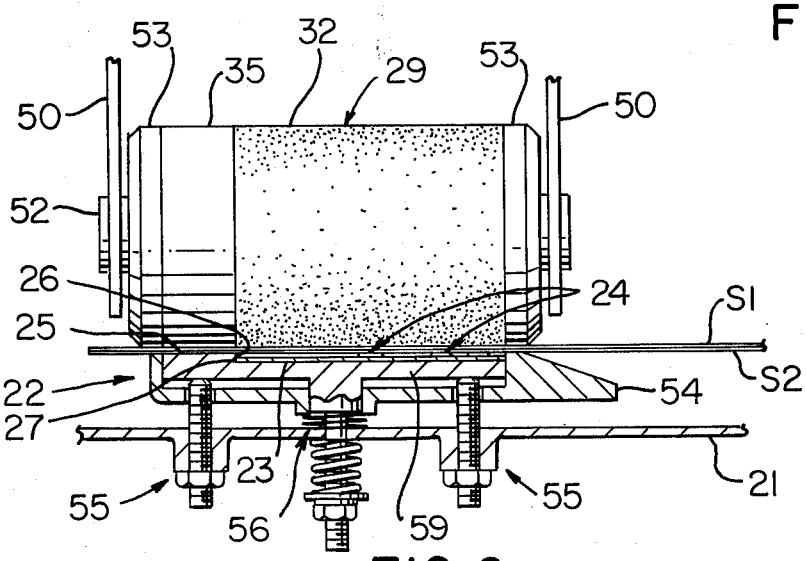
FIG. 6 is a fragmentary view with parts in elevation and parts in cross section taken essentially on the line 6—6 of FIG. 5.
Figure 8:
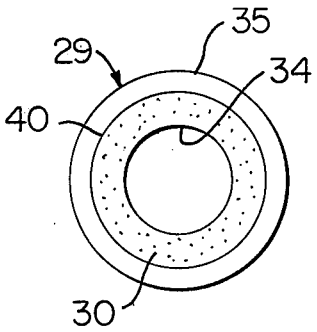
FIG. 8 is an end view of the roller of FIG. 7 showing an ink impermeable sleeve member thereof fixed in position on its associated open pore structure by shrink fitting action.

Reference is now made to FIG. 1 of the drawings which illustrates one exemplary embodiment of an apparatus for printing indicia on sheet material and such apparatus is designated generally by the reference numeral 20. The apparatus 20 comprises a base 21 and a support on the base which is designated generally by the reference numeral 22, for supporting a printing plate such as a charge card or plate 23, for example, and such plate has raised characters 24 as shown in FIGS. 4 and 6.

The support 22 has an elongated rail 25 which is in the form of a rigid non-deflectable rail supported so that its top surface remains in a fixed horizontal position. The rail 25 has an edge 26 which is particularly adapted to receive an edge 27 of the plate 23 in abutting relation thereagainst and as will be described in more detail subsequently.

The apparatus 20 has an inking roller which is designated generally by the reference numeral 29 which has an outer cylindrical surface 31 and comprises an inking portion 32 defined by a tubular porous sintered mass of particles bonded together into a homogeneous reticulated open pore structure designated by the reference numeral 30. The pores are represented by dots 33 in FIG. 9, for example; and, the pores 33 are interconnected and form continuous ink passages between the outer cylindrical surface of the inking portion 32 and an inner surface in the form of a tubular right circular cylindrical surface 34 of the roller 29. The roller 29 also has a non-inking portion which in this example is in the form of an ink impermeable member in the form of a sleeve 35, and the sleeve 35 is disposed on the structure 30 and defines at least a part of the outer cylindrical surface 31.

Figure 9:
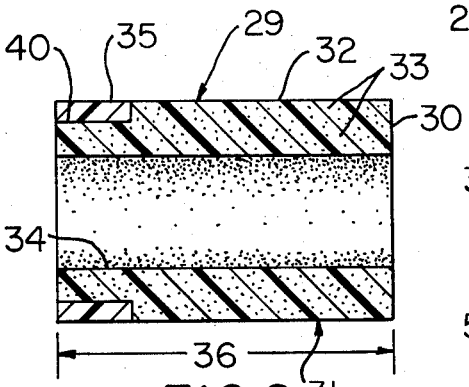
FIG. 9 is a cross-sectional view of the roller of FIG. 7 taken essentially on the line 9—9 of FIG. 7.

The roller 29 defined by structure 30 and sleeve 35 has substantially uniform deflection characteristics across its entire axial length which would be the axial length indicated at 36 in FIG. 9 and such substantially uniform deflection characteristics is assured firstly due to the fact that the impermeable sleeve 35 is basically supported on a reduced diameter portion 40 defining one end portion of the structure 30, and secondly due to the fact that it has approximately the same physical characteristics of hardness and resiliency as the structure 30. Thus, upon applying a force at any position along the outside surface 31 of the roller 29, whether such force is against inking portion 32 or sleeve 35, the roller 29 has substantially uniform deflection characteristics across its entire axial length.

Figure 5:
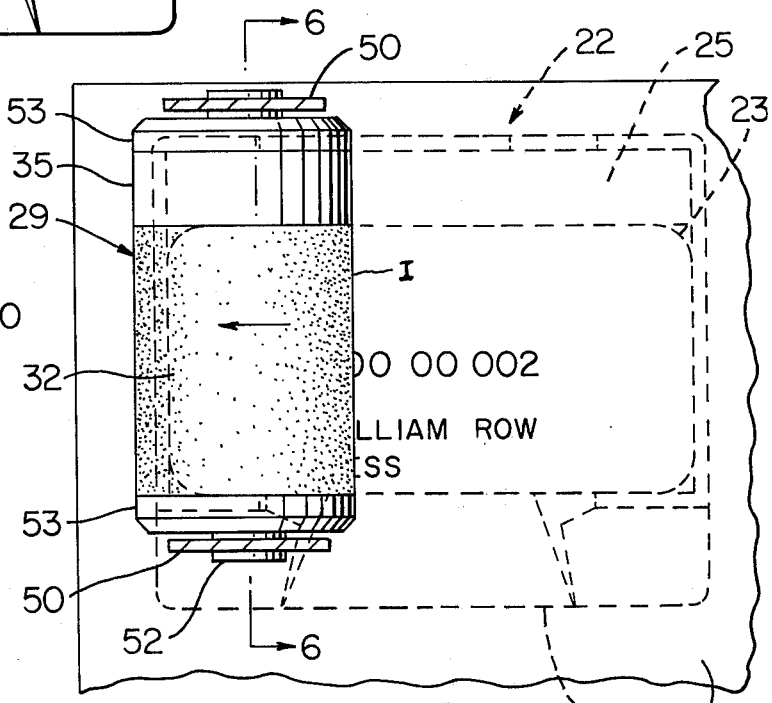
FIG. 5 is a fragmentary view illustrating a sheet material which is to be printed supported by the apparatus on the printing plate and showing the inking roller of this invention above the sheet material.

Referring again to FIG. 1, the apparatus 20 has means designated generally by the reference numeral 42 supporting the inking roller 29 for rectilinear movement, indicated by a double arrow 43, back and forth on the apparatus with the inking roller 29 exuding ink I from its inking portion 32 onto sheet material S (as seen in FIGS. 5 and 6) in response to backup pressure exerted by the characters 24 through the sheet material S. Simultaneously with the movement of inking portion 32 over the characters 24 the non-inking portion or sleeve 35 is supported by the rail 25 through the sheet material S keeping such sheet material from wrinkling and keeping ink off of the sheet material S above the rail 25 and beneath the sleeve 35. The uniform deflection characteristics of the roller 29 and action of the non-inking portion or sleeve 35 supported by the rail 25 assure inking of the sheet material S free of smearing.

As seen particularly in FIG. 1 the means 42 supporting the inking roller 29 comprises a support beam 45 carried by the base 21 and in particular carried by opposed frame members 46 fixed to and extending upwardly from opposed ends of the base 21 so that the beam 45 is supported in a substantially cantilevered manner above the plate 23. The means supporting the inking roller also includes a carrier 47 for the inking roller and the carrier has means or a device rotatably supporting the inking roller 29 thereon and such means rotatably supporting the roller comprises a bifurcate structure comprised of a pair of arms each designated by the same reference numeral 50. The arms 50 extend beneath the beam 45 and the carrier 47 has a handle 51 which is integrally formed of the upper portions of the arms 50 as a single piece thereof. The handle 51 is used for manually moving the carrier 47 so that the inking roller 29 may be moved into printing or inking engagement against the sheet S of material disposed on the plate 23 once the plate is installed in position as illustrated in FIGS. 5 and 6.

The means rotatably supporting the inking roller 29 comprises a shaft 52 rotatably supported on and carried between the arms 50 and the shaft 52 extends through a longitudinal opening axially through the structure 30 and hence through roller 29 with such opening defining the inside surface 35. The shaft 52 has a pair of hub-like portions each designated by the same reference numeral 53 which are disposed on opposite ends of the shaft 52 and the hub-like portions confine the roller 29 against axial movement. During a printing or inking operation, the hub-like portions 53 engage means in the form of a frame member 54 which is employed for confining the plate 23 against movement relative to the rail 25 and in particular against both movements parallel with the rail and transverse to such rail.

The rail 25 is defined as an integral part of a plate structure 59 which is rigidly supported by threaded assemblies 55 on the base 21 of the apparatus 20. The frame member 54 is disposed around the entire periphery of plate structure 59 and rail 25 and is yieldingly supported for vertical movement by a pair of spaced apart spring assemblies 56. With this structure, once the roller 29 is moved by moving handle 51 and carrier 47 across the plate 23, the hub-like portions 53 at opposite ends thereof engage the frame member 54 pushing it downwardly and out of the way of the roller 29 while the sleeve 35 engages the top surface of the rigid rail 25. During inking or printing, the inking portion 32 of the roller 29 moves across the sheet S and the pressure exerted through the raised indicia 24 causes printing ink I to exude and print indicia corresponding to the raised letters 24 on the sheet S on the top layer of the sheet S. Often the material S is comprised of a plurality of layers or sheets shown as S1 and S2 with sheet S1 being a carbonless type copy paper whereby the pressure exerted by the raised letters causes printing on the sheet S2 beneath the sheet S1 and in a manner well known in the art.

As previously mentioned, the structure 30 of the roller 29 is defined by a tubular porous sintered mass of particles bonded together in a homogeneous reticulated open pore structure with the pores 33 thereof being interconnected and forming a continuous passage between the inner and outer surfaces of the structure 30. One example of such a structure and method of making same is shown in U.S. Pat. No. 3,336,244 of Joseph Rockoff and such patent is assigned to the same assignee as the present application.

The ink impermeable member or sleeve 35 may be made of various materials and preferably the sleeve 35 should have the same hardness as the structure 30. A hardness for the sleeve member 35 as measured on the Shore Durometer D scale and at a value ranging between 60 and 80 has been found satisfactory for both sleeve member 35 and structure 30.

Figure 10:
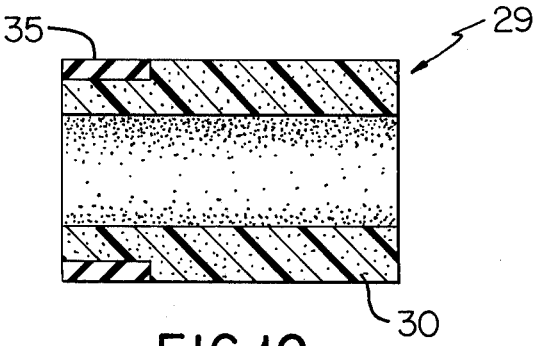
FIG. 10 is a view similar to FIG. 9 illustrating a modification of the inking roller of FIG. 9.

Sleeve member 35 may be made of any suitable plastic material and materials which have been used successfully may be selected from the group consisting of phenol formaldehyde resin, nylon, acrylonitrile-butadiene styrene, polyvinyl chloride, and polyolefins, The sleeve 35 of roller 29 may also be made of a suitable rubber material as illustrated in FIG. 10.

Figure 11:
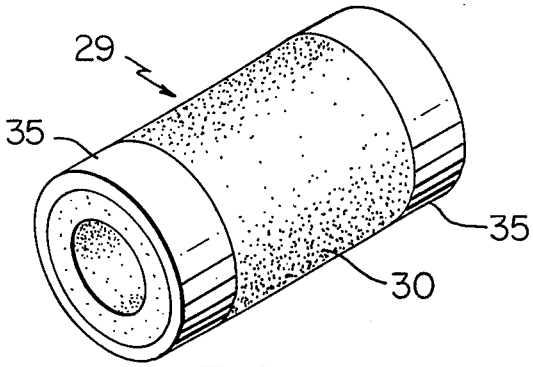
FIG. 11 is a view similar to FIG. 7 illustrating another modification of the inking roller of this invention.

The roller 29 may have a non-inking portion defined by a second ink impermeable member also designated 35 and as illustrated in FIG. 11 with the second member 35 being disposed in spaced relation from the first member or sleeve 35 and both members or sleeves 35 have the same characteristics and the same hardness as structure 30.

Instead of having ink impermeable structure in the form of a sleeve at opposed ends of a cylindrical structure such as the structure 30 it will be appreciated that a plurality of ink impermeable portions such as sleeves may be provided in various locations along the structure 30 and in accordance with techniques which are known in the art. Yet by making each member or sleeve-like portion 35 of the same hardness and of material having substantially the same resiliency and structural characteristics as the structure 30 the inking roller thus made would have substantially uniform deflection characteristics across its entire axial length and would allow printing in a non-smearing manner.

The rigid horizontal rail 25 preferably has a thickness or height above the plate 23 which may range generally between one and two thousandths of an inch. However such a rail 25 may be designed so that it is flush with the top surface of the plate 23.

Figure 7:
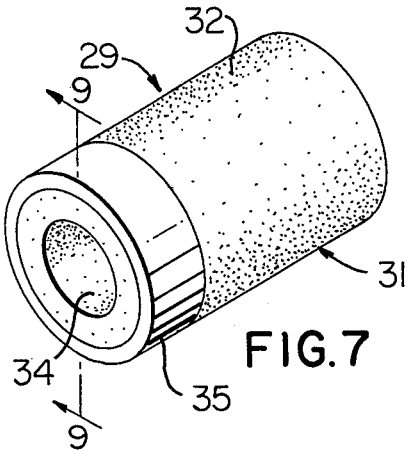
FIG. 7 is a perspective view of the inking roller utilized in the apparatus of FIGS. 1–6.
Figure 12:
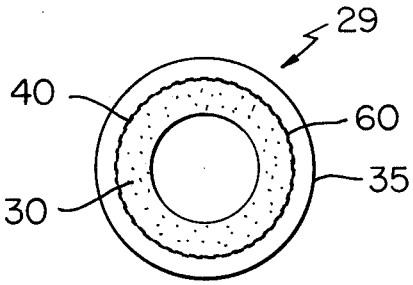
FIG. 12 is an end view similar to FIG. 8 illustrating an ink impermeable sleeve member held in position on its associated open pore structure by adhesive means.
Figure 13:
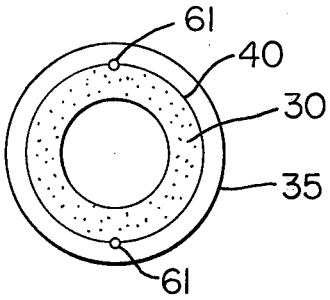
FIG. 13 is a view similar to FIG. 12 illustrating an ink impermeable sleeve member held in position on its associated open pore structure by a plurality of staking pins.

The sleeve 35 may be fixed in position on the structure 30 utilizing any suitable technique known in the art and in the illustration of FIG. 7 such sleeve is fixed in position by heat shrinking action. It will also be appreciated that such sleeve may be fixed in position by suitable adhesive means in the form of adhesive 60 as shown in FIG. 12. Similarly, the sleeve 35 may be fixed in position by staking utilizing a plurality of staking pins such as pins 61 and as illustrated in FIG. 13.

The structure 30 and roller 29 with its right circular cylindrical outside surface 31 may be defined utilizing any technique known in the art. For example, roller 29 comprised of structure 30 with sleeve 35 installed thereon may be supported on centers indicated schematically by arrows 62 in FIG. 14 whereupon the outside surface of the structure 30 and sleeve 35 may be machined as by dry grinding action using a grinder 63 to define the right circular cylindrical surface 31 across the entire axial length of the roller 29.

Figure 15:
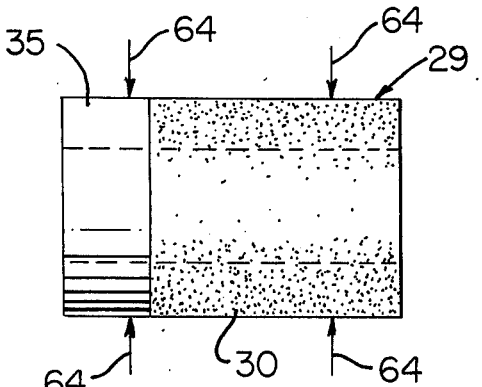
FIG. 15 is a schematic view illustrating dry grinding by centerless grinding techniques.

As illustrated schematically in FIG. 15 the structure 30 with sleeve 35 fixed thereon may be machined by centerless dry grinding techniques as represented by opposed arrows 64.

Figure 14:
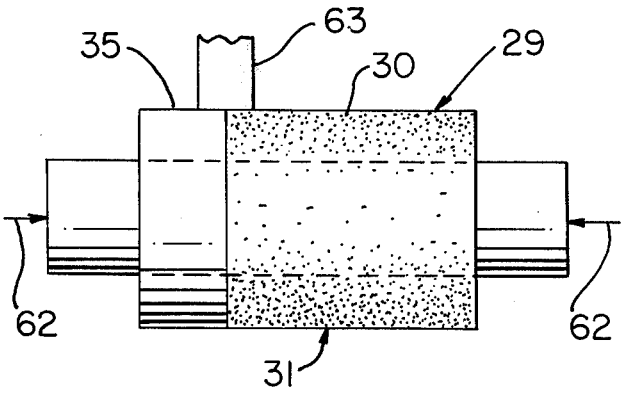
FIG. 14 is a schematic view illustrating the outer cylindrical surface of the inking roller of this invention defined by dry grinding using conventional centers to hold a supporting shaft for the roller in position.

The above description made in connection with FIGS. 14 and 15 shows the grinding being achieved with a sleeve 35 installed in position on the open pore structure 30; however, it will be appreciated that the machining or grinding of the structure 30 may be achieved prior to installation of the ink impermeable sleeve 35. In this latter instance the sleeve 35 may be suitably finished so that the outside diameter thereof will be substantially the same as the outside diameter of the machined or ground structure 30 whereby the overall outside surface 31 of the roller would be substantially a continuous outside surface 31.

In the process of making the roller 29 the sintered mass of particles may be bonded together to define the homogeneous reticulated open pore structure 30 having pores interconnected in continuous passages between the inner and outer surfaces of the structure. The bonding and forming of structure 30 may be achieved independently of the sleeve 35 with such sleeve being independently formed and cured; however, the forming of the structure 30 and curing of an uncured sleeve member 35 may be achieved simultaneously whereby the final forming operation on roller 29 may be basically one operation wherein such roller 29 is subjected to heat and pressure followed by cooling thereof and grinding of its outside surface to define the right circular cylindrical surface 31.

The roller 29 of this invention is considered superior to similar types of rollers used in the art in which an open pore structure is fixed in position on a common rigid shaft with an ink impermeable member which has its inside supported surface engaging such shaft. This superiority is believed due to the fact that the deflection characteristics of the ink impermeable member are, in essence, substantially the same as the open pore structure 30 since the ink impermeable member such as sleeve 35 is carried on the structure 30. With the above construction the ink roller of this invention has the characteristics of a single roller yet has both inking and non-inking portions.

While present exemplary embodiments of this invention, and methods of practicing the same, have been illustrated and described it will be recognized that this invention may be otherwise variously embodied and practiced within the scope of the following claims.

What is claimed is:

1. An inking roller having an outer cylindrical surface comprising an inking portion defined by a tubular porous sintered mass of particles bonded together in a homogeneous reticulated open pore structure having pores throughout, said pores being interconnected and forming continuous passages between said outer surface and an inner surface of said structure, and a non-inking portion defined by an ink impermeable member disposed on said cylindrical structure and defining at least part of said outer surface, said structure having an integral reduced diameter cylindrical portion at one end thereof, said member being in the form of a tubular sleeve having a cylindrical outside surface which defines said part of said outer surface, said sleeve being fixed to said reduced diameter cylindrical portion, said roller having substantially uniform deflection characteristics across its entire axial length.

2. A roller as set forth in claim 1 in which said structure and said member have approximately the same hardness.

3. A roller as set forth in claim 1 in which said member is made from a material selected from the group consisting of phenol formaldehyde resin, nylon, acrylonitrile-butadiene, polyvinyl chloride, and polyolefins.

4. A roller as set forth in claim 1 in which said member is made of rubber.

5. A roller as set forth in claim 1 in which said non-inking portion is defined by another ink impermeable member disposed on said open pore structure in spaced relation from said first-named ink impermeable member and defining said part of said outer surface.

6. A roller as set forth in claim 5 in which said other member is also in the form of a tubular sleeve, said sleeves being disposed in axially spaced relation along said structure.

7. An apparatus for printing indicia on sheet material comprising, a base, a support on said base for supporting a printing plate having raised characters, said support having an elongated rail which receives an edge of said printing plate in abutting relation thereagainst, an inking roller, said inking roller having an outer cylindrical surface and comprising an inking portion defined by a tubular porous sintered mass of particles bonded together into a homogeneous reticulated open pore structure having pores throughout, said pores containing ink and being interconnected and forming continuous ink passages between said outer surface and an inner surface of said structure, said inking roller having a non-inking portion defined by an ink impermeable member disposed on said cylindrical structure and defining at least a part of said outer surface, said structure having an integral reduced diameter cylindrical portion at one end thereof, said member being in the form of a tubular sleeve having a cylindrical outside surface which defines said part of said outer surface, said sleeve being fixed to said reduced diameter cylindrical portion, said roller having substantially uniform deflection characteristics across its entire axial length, and means supporting said inking roller for rectilinear movement with said noninking portion being supported solely by said rail with only said sheet material interposed therebetween and said roller exuding ink from its inking portion on said sheet material in response to backup pressure exerted by said raised characters through said sheet material to print corresponding indicia thereon, said uniform deflection characteristics and action of said non-inking portion assuring inking of said sheet material free of both smearing and wrinkling thereof.

8. An apparatus as set forth in claim 7 in which said means supporting said inking roller for rectilinear movement comprises a support beam carried by said base above said rail and a carrier for said inking roller.

9. An apparatus as set forth in claim 8 in which said carrier has a device rotatably supporting said inking roller thereon.

10. An apparatus as set forth in claim 9 in which said device rotatably supporting said inking roller comprises a bifurcate structure having a pair of arms disposed beneath said beam and said apparatus further comprises means enabling movement of said carrier.

11. An apparatus as set forth in claim 10 in which said means enabling movement of said carrier comprises a handle for manually moving said carrier.

12. An apparatus as set forth in claim 10 in which said device rotatably supporting said inking roller comprises a shaft rotatably supported between said arms, said shaft extending through an axial opening in said open pore structure.

13. An apparatus as set forth in claim 10 in which said device rotatably supporting said inking roller comprises a shaft rotatably supported between said arms, said shaft extending through an axial opening in said open pore structure, and said device further comprising a pair of hub-like portions disposed on said shaft around opposed ends thereof.

14. An apparatus as set forth in claim 8 in which said base has a back edge and said means supporting said inking roller for rectilinear movement comprises a pair of frame members carried by said base in a cantilevered manner and extending above said back edge.

15. An apparatus as set forth in claim 7 and further comprising means confining said plate against movement relative to said rail.

16. An apparartus as set forth in claim 15 in which said means confining said plate comprises a frame member disposed completely around said printing plate and being resiliently supported for yielding vertical movements.

17. A method of printing indicia on sheet material in a substantially non-smearing manner comprising the steps of, supporting a printing plate having raised characters horizontally in a rigid manner with an edge of said printing plate against a rigid elongated horizontal rail, providing an inking roller having an outer cylindrical surface and comprising an inking portion defined by a tubular porous sintered mass of particles bonded together into a homogeneous reticulated open pored structure having pores throughout, said pores containing ink and being interconnected and forming continuous passages between said outer cylindrical surface and an inner surface of said structure, said inking roller having a non-inking portion defined by an ink impermeable member disposed on said cylindrical structure and defining at least part of said outer surface, said structure having an integral reduced diameter cylindrical portion at one end thereof, said member being in the form of a tubular sleeve having a cylindrical outside surface which defines said part of said outer surface, said sleeve being fixed to said reduced diameter cylindrical portion, said roller having substantially uniform deflection characteristics across its entire axial length, supporting said inking roller for rectilinear movement with said noninking portion being supported solely by said rail with only said sheet material interposed therebetween with said roller exuding ink from its inking portion on said sheet material in response to backup pressure exerted by said raised characters through said sheet material to print corresponding indicia thereon, said uniform deflection characteristics and action of said non-inking portion assuring inking of said sheet material in said non-smearing manner and free of wrinkling thereof.

18. A method as set forth in claim 17 in which said supporting step comprises supporting said inking roller for back and forth rectilinear movement on a support beam disposed above said rail.

19. A method as set forth in claim 18 in which said supporting step comprises rotatably supporting said roller during rectilinear movement thereof whereby said roller is rotated by engagement thereof against said sheet material during said rectilinear movement.

20. A method as set forth in claim 19 and comprising the further step of confining said printing plate against movement relative to said rail during said supporting step with a frame member disposed completely around said printing plate.

* * * * *